United States Patent [19]

Onoue

[11] Patent Number: 5,018,999

[45] Date of Patent: May 28, 1991

[54] PROPELLER DRIVING DEVICE OF MARINE PROPULSION UNIT

[75] Inventor: Akihiro Onoue, Hamamatsu, Japan

[73] Assignee: Sanshin Kogyo Kabushiki Kaisha, Hamamatsu, Japan

[21] Appl. No.: 335,805

[22] Filed: Apr. 10, 1989

Related U.S. Application Data

[63] Continuation-in-part of Ser. No. 145,965, Jan. 20, 1988, abandoned.

[30] Foreign Application Priority Data

Jan. 23, 1987 [JP] Japan ..... 62-13867
Apr. 11, 1988 [JP] Japan ..... 63-87187

[51] Int. Cl.[5] ..... B63H 21/24

[52] U.S. Cl. ..... 440/78; 440/83; 440/900

[58] Field of Search ..... 440/49, 73, 75, 78, 440/79, 83, 86, 112, 900

[56] References Cited

U.S. PATENT DOCUMENTS

| | | | |
|---|---|---|---|
| 3,937,093 | 2/1976 | Johnson et al. | 440/78 |
| 4,650,430 | 3/1987 | Schiek | 440/88 |
| 4,801,281 | 1/1989 | Govan | 440/73 |
| 4,815,996 | 3/1989 | Carr | 440/83 X |

*Primary Examiner*—Ed Swinehart
*Attorney, Agent, or Firm*—Ernest A. Beutler

[57] ABSTRACT

An outboard motor lower unit construction including a bearing carrier that supports the propeller shaft and which extends into a cavity formed in the lower unit. The bearing carrier is held by a fasteners that is protected from extension into the body of water in which the watercraft associated with the outboard motor is operating so as to prevent turbulence. In some embodiments, the fasteners is covered by a cover plate and in other embodiments, the fasteners is protected by the hub of the associated propeller.

7 Claims, 5 Drawing Sheets

PROPELLER DRIVING DEVICE OF MARINE PROPULSION UNIT

CROSS REFERENCE TO RELATED APPLICATION

This application is a continuation-in-part of my application entitled "Propeller Housing Retainer For Marine Propulsion Device", Ser. No. 145,965, filed Jan. 20, 1988 and assigned to the assignee of this application, now abandoned.

BACKGROUND OF THE INVENTION

This invention relates to a propeller driving device for a marine propulsion unit and more particularly to an improved bearing supporting arrangement for the propulsion shaft of a marine propulsion unit.

As is well known, many types of outboard-drive units employ a lower unit in which a forward, neutral, reverse transmission is positioned for driving a propeller shaft to propel an associated watercraft. Normally, the propeller shaft is mounted within a cavity formed in the lower unit casing and is supported by means of a bearing carrier that is inserted into the rear end of this opening and is held in place by fastening devices. Normally, these fastening devices include bolts or studs and nuts with the heads exposed so as to facilitate insertion and removal. However, the exposed heads of the fasteners can give rise to turbulence that will decrease the efficiency of the propulsion unit. Furthermore, the exposed fasteners can also be damaged and give rise to difficulties in disassembly.

It is, therefore, a principal object of this invention to provide an improved arrangement for supporting a propulsion shaft of an outboard drive.

It is a further object of this invention to provide a fastening arrangement for a propeller shaft support wherein the fasteners do not interfere with the water stream and also will be protected from damage.

In connection with the fastening of the bearing carrier to the outer housing, the dissimilarity of metals used between the outer housing and the fasteners can give rise to corrosion problems. If corrosion occurs, it may be very difficult to disasssemble the components for servicing.

It is, therefore, a still further object of this invention to provide an improved fastening arrangement wherein corrosion will be minimized and disassembly facilitated.

SUMMARY OF THE INVENTION

This invention is adapted to be embodied in a lower unit construction for a marine outboard drive that is comprises of a lower unit casing that defines a generally rearwardly extending opening through which a driven propeller shaft passes. A bearing carrier extends into the opening for journaling the propeller shaft and closing the opening. Fastening means affix the bearing carrier to the lower unit casing at a rear face thereof. In accordance with the invention, means are provided for covering the fastening means for preventing the fastening means from creating turbulence upon the passage of the lower unit through the water.

In accordance with another feature of the invention, means are provided for delivering lubricant to the fastening means so as to avoid corrosion and facilitate disassembly.

DETAILED DESCRIPTION OF THE PREFERRED EMBODIMENTS

Figure 1:
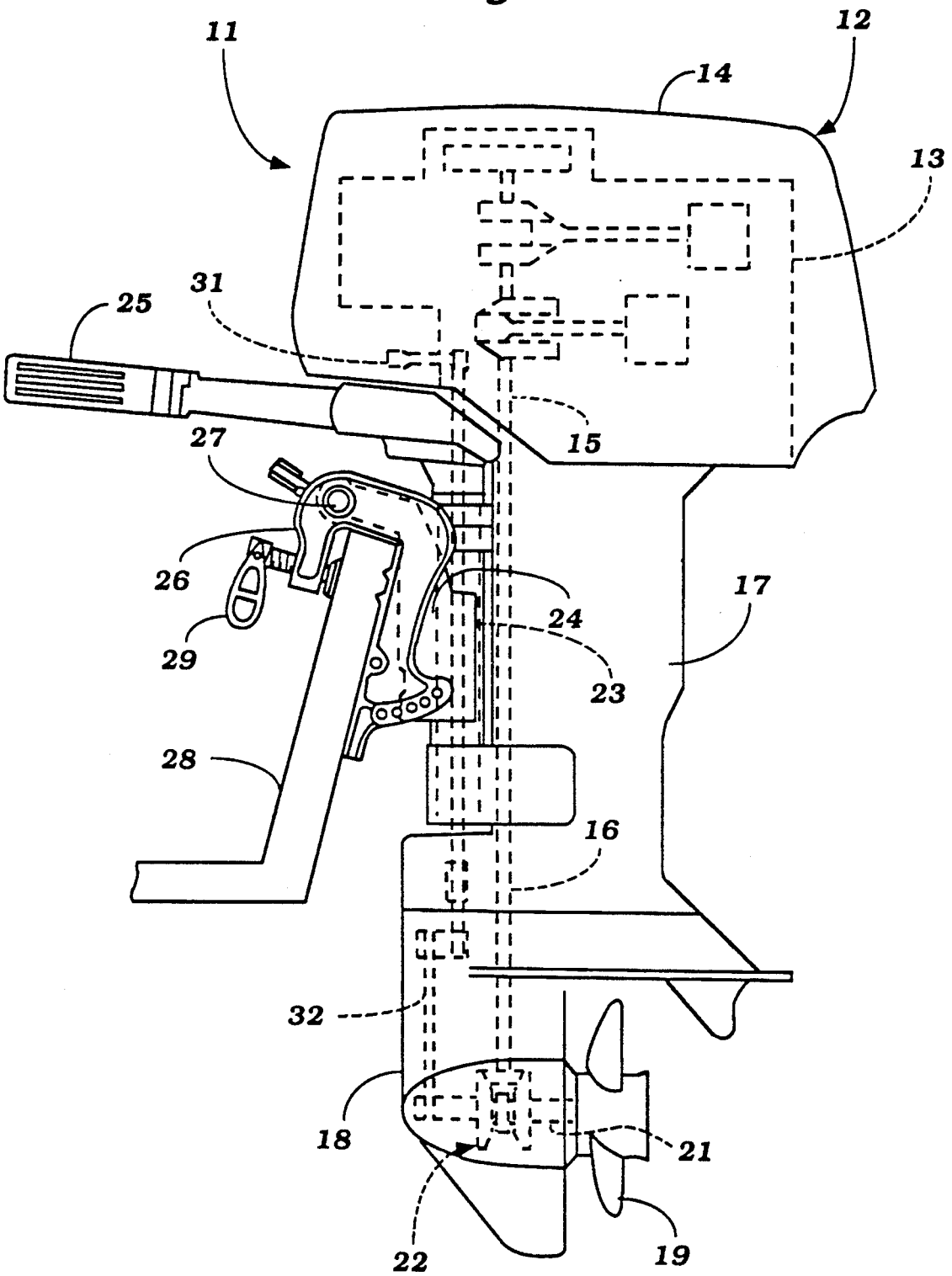
FIG. 1 is a side elevational view of an outboard motor constructed in accordance with an embodiment of the invention.

Referring first in detail to FIG. 1, an outboard motor constructed in accordance with an embodiment of the invention is identified generally by the reference numeral 11. The outboard motor 11 is depicted as being a typical environment in which the invention may be practiced. It is to be understood, however, that facets of the invention can be utilized in conjunction with the outboard drive portion of an inboard/outboard drive and the term "outboard drive" as used herein is intended to generically encompass both outboard motors per se and the outboard drive portion of an inboard/-outboard drive arrangement.

The outboard motor 11 is comprised of a power head, indicated geneally by the reference numeral 12, and consisting of an internal combustion engine 13, which may be of any known type and which is surrounded by a protective cowling 14. The engine 13, as is typical with outboard motor practice, is supported with its output shaft 15 (in this case a crankshaft) for rotation about a vertically extending axis.

The engine output shaft 15 is drivingly coupled in a known manner to a drive shaft 16 which is, in turn, journaled for rotation about a vertically extending axis within a drive shaft housing 17. The drive shaft 16 depends from the drive shaft housing 17 into a lower unit 18 wherein it drives a propeller 19 that is connected to a propeller shaft 21 through a forward, neutral, reverse transmission, indicated generally by the reference numeral 22 and of a type to be described.

A steering shaft 23 is affixed to the drive shaft housing 17 and is supported within a swivel bracket assembly 24 for steering of the outboard motor 11 about a vertically extending steering axis. A tiller 25 is affixed to the upper end of the steering shaft 23 so as to facilitate this steering operation.

The swivel bracket 24 is pivotally connected to a clamping bracket 26 by means of a horizontally extending pivot pin 27. This permits tilt and trim movement of the outboard motor 11 relative to a transom 28 of an associated watercraft to which the outboard motor 11 is affixed by means of a clamping device 29 of the clamping bracket 26.

The shifting of the transmission 22 is controlled by a shift control lever 31 that is mounted on the power head 12 and which is connected to the shifting mechanism in a manner to be described by means including a vertically extending shift rod 32. The construction of the outboard motor 11 as thus far described may be considered to be generally conventional, insofar as the subject matter of the invention is concerned and, for that reason, further description of the general construction of the outboard motor 11 is not believed to be necessary to understand the construction and operation of the invention.

Figure 2:
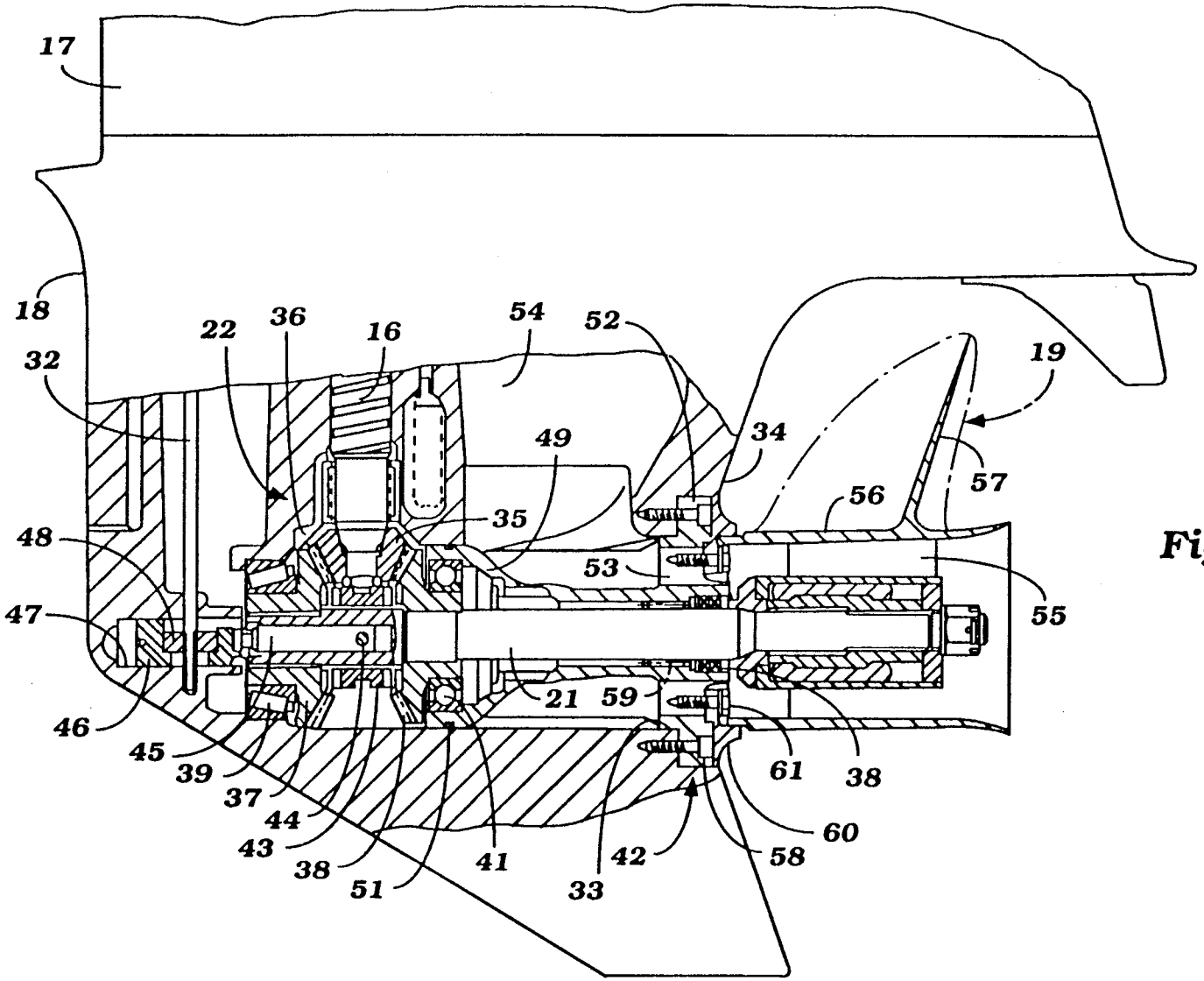
FIG. 2 is an enlarged side elevational view of the lower unit, with a portion broken away and shown in section.
Figure 3:
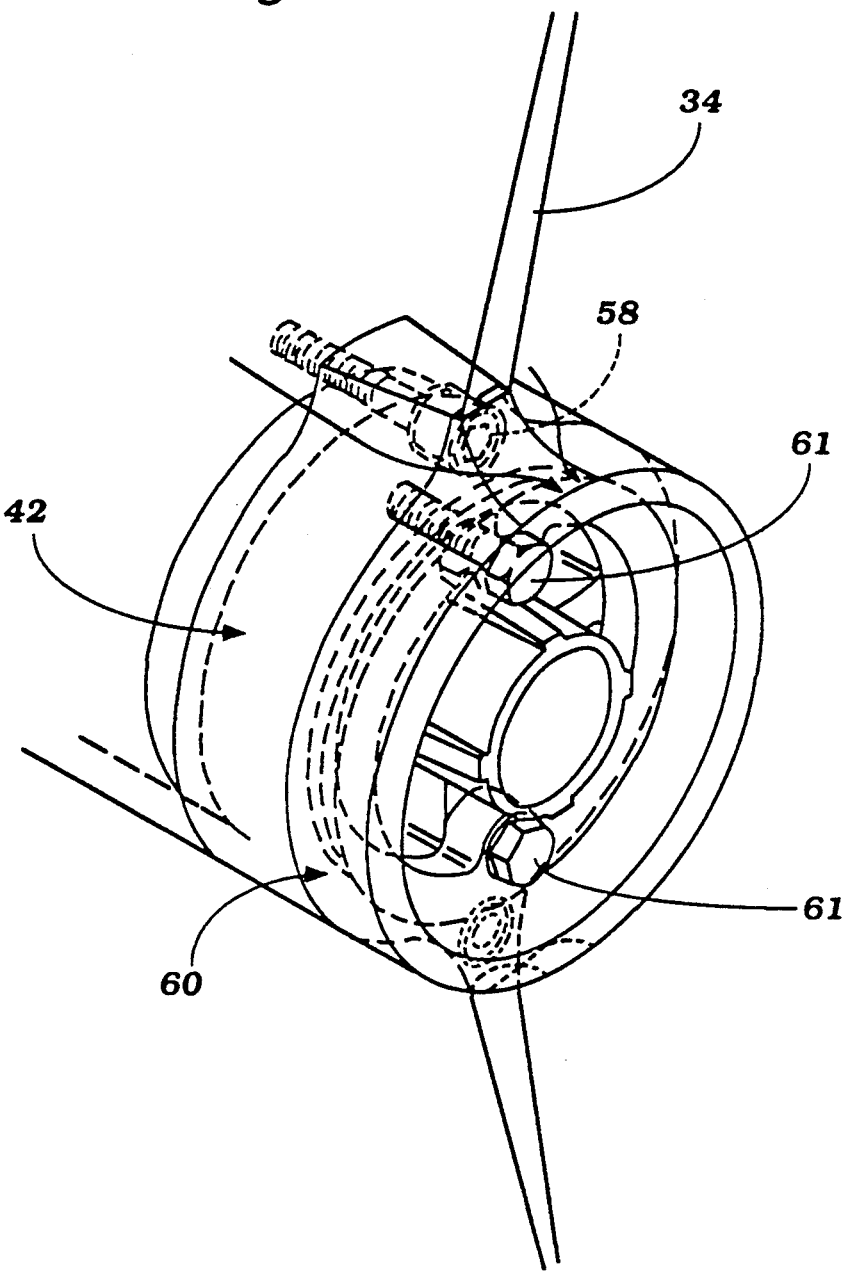
FIG. 3 is an enlarged perspective view showing the construction of the fastening arrangement for the bearing carrier in this embodiment.

Referring now specifically to FIGS. 2 and 3 the construction of the foward, neutral, reverse transmission 22 and the support and driving arrangement for the propeller shaft 21, which incorporates the invention, rearwardly opening cavity 33 into which the propeller shaft 21 extends and which is supported for rotation therein in a manner to be described. This cavity 31 opens through a rear face 34 of the lower unit 18.

The transmission 22 includes a driving bevel gear 35 that is affixed to the lower end of the drive shaft 16 within a further cavity 36 formed forwardly of the cavity 33. The driving bevel gear 35 is enmeshed with a pair of counterrotating bevel gears 37 and 38 that are supported within the cavity 36 and which are journaled on the forward end of the propeller shaft 21. The bevel gear 37 is journaled by means of a thrust bearing 39 that is affixed in the lower unit housing 18 at the forward end of the cavity 33. The bevel gear 38 is journaled by means of a ball bearing 41 which, in turn, is supported within a bearing carrier, indicated generally by the reference numeral 42 and which will be described later in more detail.

The forward end of the propeller shaft 21 is, as has been noted, rotatably journaled within the driven bevel gears 37 and 38 and slidably supports, by means of a splined connection, a dog clutching sleeve 43. The dog clutching sleeve 43 has opposite facing dog clutching teeth that are adapted to be engaged with corresponding dog clutching teeth on the gears 37 or 38 for rotatably coupling either of these gears to the propeller shaft 21 so as to drive the propeller 19 in selected forward or reverse directions.

The dog clutching sleeve 43 is connected by means of a pin 44 to a shift plunger 45 that is slidably supported within a bore in the forward end of the propeller shaft 21. The plunger 45 has a headed portion that is received within a shift actuator 46 that is supported within a bore 47 at the forward end of the lower unit housing 18. A shift cam 48 is affixed to the shift control rod 32 and upon rotation of the shift control rod 32 will reciprocate the actuator 46 and plunger 45 to effect shifting of the transmission 22 into the forward or reverse drive modes.

The bearing carrier 42 is provided with an enlarged cylindrical forward portion 49 that receives and supports the bearing 41. An O-ring seal 51 encircles the portion 49 and sealingly engages the cavity 33 so as to provide a watertight seal for the cavity 36 in which the transmission 22 is contained. At the rear end, the bearing carrier 42 is formed with a cylindrical portion 52 that is formed with a pair of lugs or flanges and which defines a series of circumferentially spaced openings 53. These openings communicate with an exhaust gas discharge 54 formed in the lower unit 18 and which receives exhaust gases from the engine 13 in a known manner for discharge to the body of water in which the outboard motor 11 is operating through a plurality of axially extending passages 55 formed in a hub 56 of the propeller 18. Propeller blades 57 extend outwardly from the hub 56.

The bearing carrier portion 53 is formed with openings through which socket headed screws 58 pass for affixing the bearing carrier 42 to the lower unit 18. Anti-friction bearings 59 carried adjacent the portion 52 journal the rear end of the propeller shaft 21.

In order to provide a smooth water flow and to protect the socket headed screws 53, there is provided a generally annular cover assembly 60 which closes the rear end of the cavity 33 and which is held to the bearing carrier 42 by means of a plurality of bolts 61. It should be noted that the bolt circle for the bolts 61 is disposed radially inwardly of the propeller hub 56 so that the heads of the bolts 61 will not be exposed and so as to provide a streamlined assembly but one which is nevertheless readily accessible for assembly and disassembly. Furthermore, the construction is such that the heads of the bolts 61 will be protected from damage by the propeller 19.

Figure 4:
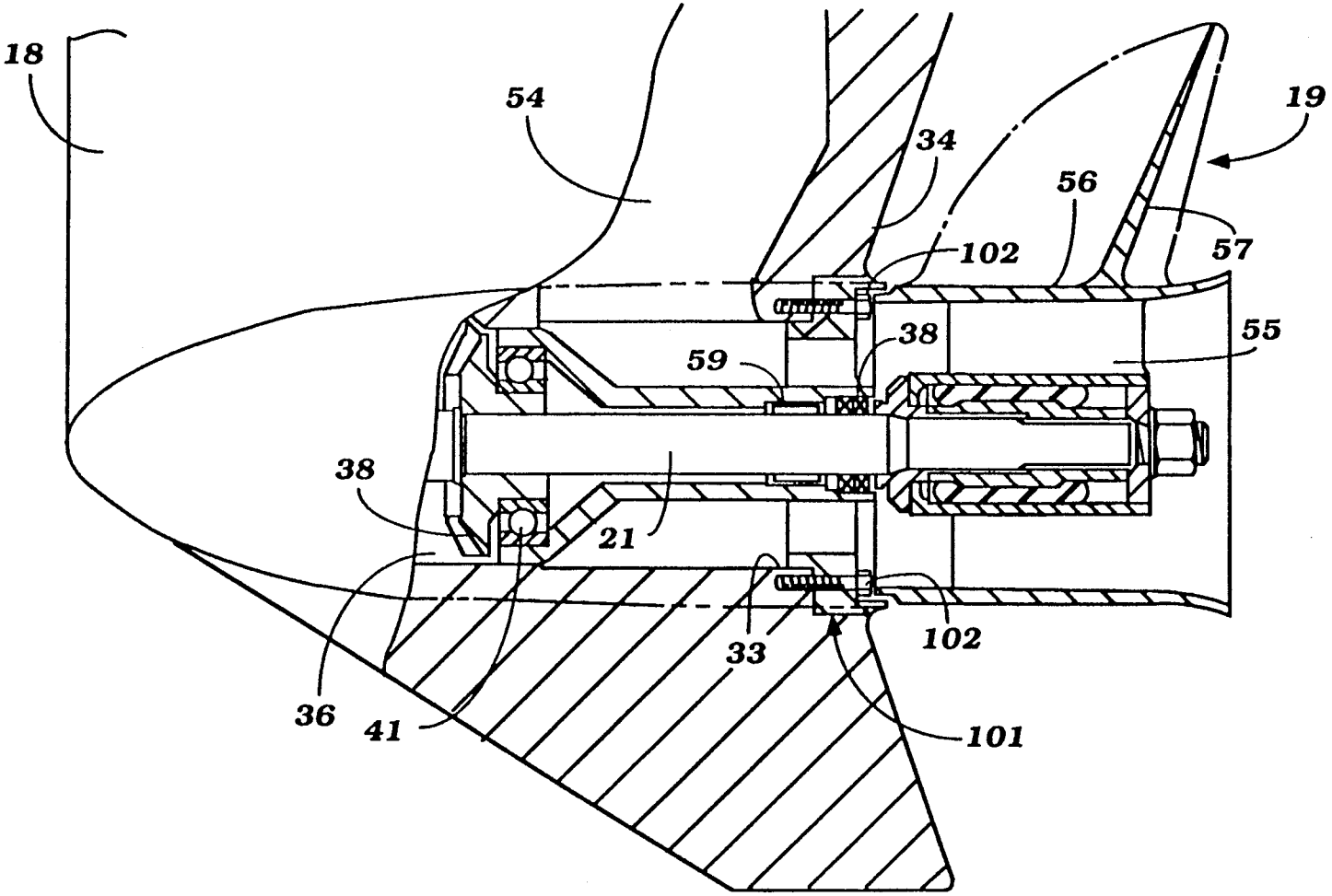
FIG. 4 is a side elevational view, in part similar to FIG. 2, with a portion broken away and showing a further embodiment of the invention.

In the embodiment thus far described, the bearing carrier was held in position by socket headed screws and these screws were covered by a cover plate. FIG. 4 shows another embodiment of the invention wherein the cover plate is eliminated. Because of the similarity of this embodiment to the previously described embodiment, those components which are the same as those previously described have been identified by the same reference numerals and will not be described again, except insofar as is necessary to understand the construction and operation of this embodiment.

In this embodiment, the bearing carrier, which is indicated generally by the reference numeral 101, is held in place in the opening 33 by means of bolts 102. The bolts 102 are disposed immediately adjacent the rear face 34 of the lower unit 18 and, hence, are not protected by the cover plate of the previously described embodiment. However, the bolt circle for the bolts 102 is less than the diameter of the hub 56 of the propeller 19 so that the propeller 19 and specifically its hub 56 will conceal and protect the heads of the bolts 102 in the same manner that the bolts 61 of the previously described embodiment were protected.

Figure 6:
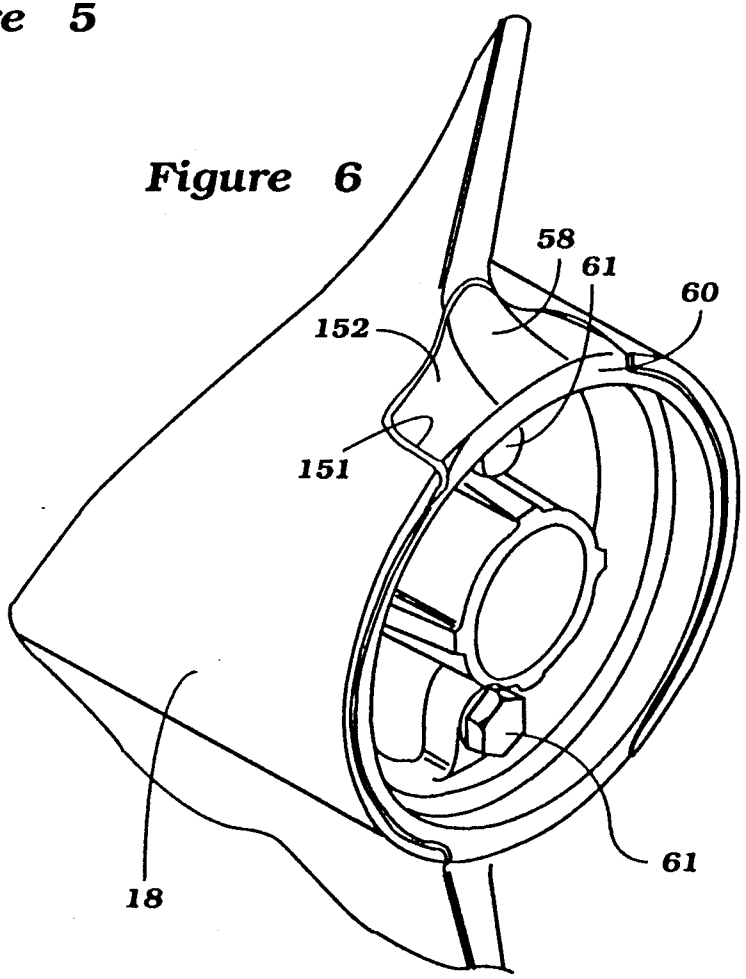
FIG. 6 is a perspective view, in part similar to FIG. 3, the construction of the embodment of FIG. 5.
Figure 5:
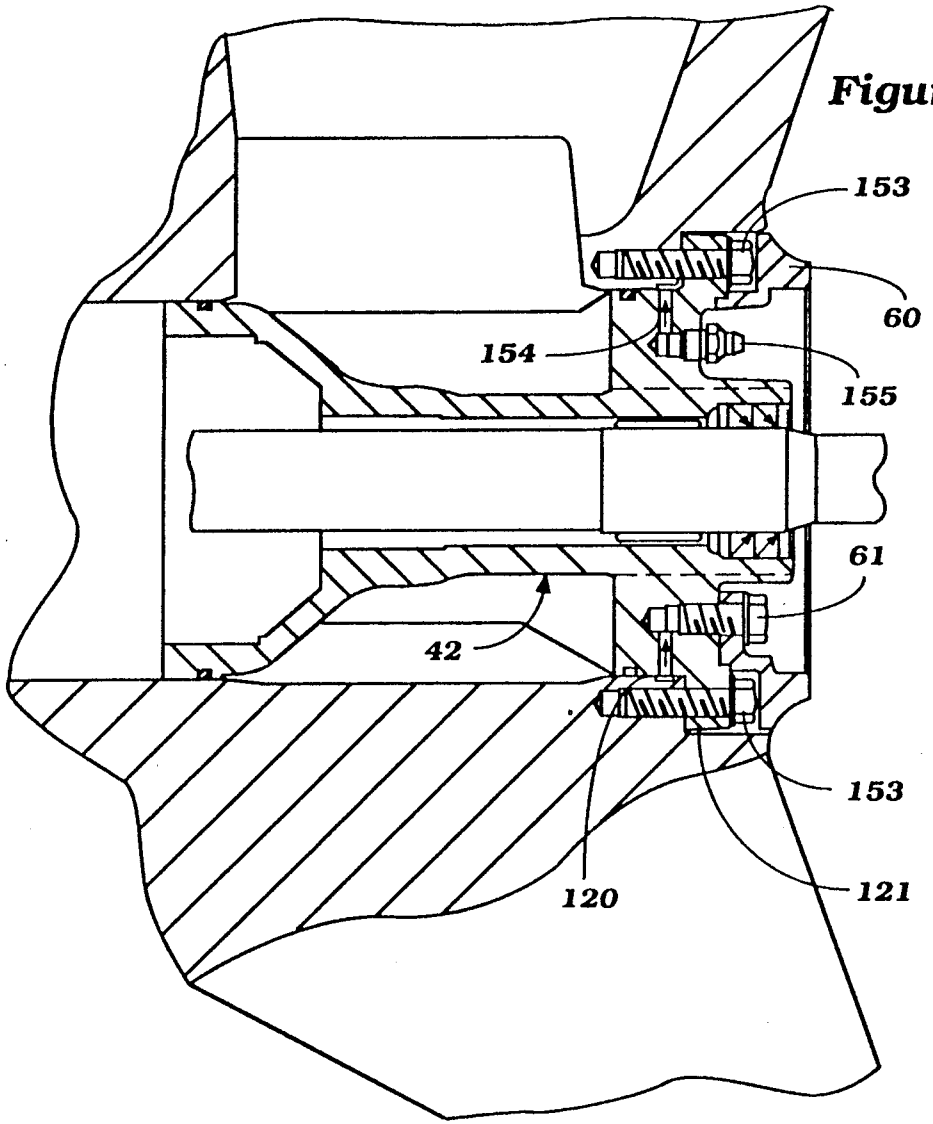
FIG. 5 is a side elevational view, with a portion broken away, in part similar to FIGS. 2 and 4, and shows a still further embodiment of the invention.

Referring now to FIGS. 5 and 6, these figures illustrate an embodiment which is generally the same as the embodiment of FIGS. 1 through 3. However, it should be noted that in this embodiment the lower unit 18 is formed with a pair of recesses 151 into which lugs 152 of the cover plate 60 extend. As a result, the cover plate 60 will be further held against rotation. In addition, rather than socket headed screws, the bearing carrier 42 is held in position by means of bolts 153. The bolts 153 are formed from a different material than the lower unit housing 18 and, accordingly, there arises the problem of electro-galvanic corrosion. However, the bearing carrier 42 is formed with a plurality of grease passages 154 that emanate from a grease fitting 155 that is screwed into the rear of the bearing carrier 42 and which extend to both the bolts 151 that hold the bearing carrier 42 to the lower unit 18 and also the bolts 61 that secure the cover 60 in place. As a result, the threaded connections will be lubricated and protected from the body of water so as to reduce the likelihood of galvanic corrosion.

It should be readily apparent from the foregoing description that several embodiments of the invention have been illustrated and described and each of which provides a means for attaching the bearing carrier to the lower unit in such a way that the fasteners will be concealed and protected. In addition, an arrangement has been disclosed for reducing the likelihood of corrosion to these components. Although a number of embodiments of the invention have been illustrated and described, various changes and modifications may be made without departing from the spirit and scope of the invention, as defined by the appended claims.

What is claimed is:

1. In a lower unit construction for a marine outboard drive comprised of a lower unit casing defining a generally rearwardly extending opening defined by a rear face of said drive unit casings and through which a driven propeller shaft passes, a bearing carrier extending into said opening for journaling said propeller shaft and closing said opening, fastening means for affixing said bearing carrier to said lower unit casing entirely within said opening and contiguous to and forwardly of said rear face thereof, and means extending at least in part into said opening for covering said fastening means to prevent said fastening means from causing turbulence upon the passage of said lower unit through the water.

2. In a lower unit construction as set forth in claim 1 wherein the means for covering the fastening means comprises a cover plate affixed to the lower unit.

3. In a lower unit construction as set forth in claim 2 wherein the cover plate is affixed to the lower unit by further fastening means.

4. In a lower unit construction as set forth in claim 3 further including means for preventing the further fastening means that secure the cover plate to the lower unit from causing turbulence in the water.

5. In a lower unit construction as set forth in claim 4 wherein the means for preventing the further fastening means for the cover plate from causing turbulence comprises a hub on a propeller affixed to the propeller shaft extending radially outwardly beyond said further fastening means.

6. In a lower unit construction as set forth in claim 3 wherein the means for preventing the fastening means for the cover plate from causing turbulence comprises a hub on a propeller affixed to the propeller shaft extending radially outwardly beyond said fastening means.

7. In a lower unit construction as set forth in claim 6 wherein one of the fastening means comprises threaded fastening means and further including lubricant means for delivering lubricant to the threads of said threaded fastening means for preventing corrosion thereof.

* * * * *